US009187297B2

(12) United States Patent
Sugano et al.

(10) Patent No.: US 9,187,297 B2
(45) Date of Patent: Nov. 17, 2015

(54) HYDRAULIC DRIVING APPARATUS FOR WORKING MACHINE

(75) Inventors: Naoki Sugano, Kobe (JP); Satoshi Maekawa, Kobe (JP); Katsuki Yamagata, Akashi (JP); Takaharu Michida, Akashi (JP); Hiroo Kondo, Akashi (JP); Naoya Kitazumi, Akashi (JP); Naoto Hori, Akashi (JP)

(73) Assignees: KABUSHIKI KAISHA KOBE SEIKO SHO, Kobe-shi (JP); KOBELCO CRANES CO., LTD., Tokyo (JP)

( * ) Notice: Subject to any disclaimer, the term of this patent is extended or adjusted under 35 U.S.C. 154(b) by 737 days.

(21) Appl. No.: 13/467,453

(22) Filed: May 9, 2012

(65) Prior Publication Data

US 2012/0285152 A1 Nov. 15, 2012

(30) Foreign Application Priority Data

May 13, 2011 (JP) ..... 2011-108293
Sep. 26, 2011 (JP) ..... 2011-209678

(51) Int. Cl.
*F15B 15/20* (2006.01)
*B66D 1/44* (2006.01)
*F15B 11/044* (2006.01)

(52) U.S. Cl.
CPC ..... *B66D 1/44* (2013.01); *F15B 11/0445* (2013.01); *F15B 2211/20546* (2013.01);
(Continued)

(58) Field of Classification Search
CPC ..... B66D 1/44; F15B 11/0445
USPC ..... 60/356, 422, 445, 446, 468
See application file for complete search history.

(56) References Cited

U.S. PATENT DOCUMENTS 3,895,564 A * 7/1975 Pinson ..... 91/418
5,884,984 A 3/1999 Arai et al.
(Continued)

FOREIGN PATENT DOCUMENTS

CN 1174596 A 2/1998
CN 1697933 A 11/2005
(Continued)

OTHER PUBLICATIONS

Office Action issued Mar. 18, 2013, in German Patent Application No. 10 2012 207 880.0 with English translation.
(Continued)

*Primary Examiner* — Dwayne J White
*Assistant Examiner* — Matthew Wiblin
(74) *Attorney, Agent, or Firm* — Oblon, McClelland, Maier & Neustadt, L.L.P.

(57) ABSTRACT

Provided is an apparatus to lower a load, comprising a hydraulic pump, a hydraulic actuator having first and second ports, a manipulation device, a hydraulic circuit including meter-in and meter-out flow passages for the first and second ports respectively and a regeneration flow passage with a check valve, a control valve, a meter-out flow controller adjusting a meter-out flow rate according to the manipulation device, a back pressure valve, and a non-regeneration operation relief valve whose set pressure is not less than a sum of a minimum set pressure of the back pressure valve, an inlet-outlet pressure difference of the meter-out flow controller when the meter-out flow rate is maximum and a discharge flow rate of the hydraulic pump is maximum, and an actuator pressure difference for driving the hydraulic actuator with no load, and not less than a maximum set pressure of the back pressure valve.

8 Claims, 10 Drawing Sheets

(52) U.S. Cl.
CPC ..... *F15B 2211/3116* (2013.01); *F15B 2211/40569* (2013.01); *F15B 2211/46* (2013.01); *F15B 2211/7058* (2013.01); *F15B 2211/761* (2013.01)

(56) References Cited

U.S. PATENT DOCUMENTS

| | | | | |
|---|---|---|---|---|
| 6,378,303 | B1 * | 4/2002 | Higuchi et al. | 60/468 |
| 6,393,838 | B1 * | 5/2002 | Moriya et al. | 60/422 |
| 2005/0011190 | A1 * | 1/2005 | Bitter | 60/468 |
| 2006/0048508 | A1 | 3/2006 | Nakamura et al. | |
| 2007/0151238 | A1 * | 7/2007 | Kraft | 60/445 |
| 2009/0308068 | A1 | 12/2009 | Yoshino | |

FOREIGN PATENT DOCUMENTS

| | | | | |
|---|---|---|---|---|
| CN | 1914384 | A | 2/2007 | |
| DE | 27 19 585 | C2 | 4/1982 | |
| DE | 199 13 277 | B4 | 11/2007 | |
| JP | 10-267007 | | 10/1998 | |
| JP | 2000-310201 | | 11/2000 | |
| WO | WO 2008147303 | A1 * | 12/2008 | F15B 11/024 |

OTHER PUBLICATIONS

U.S. Appl. No. 13/467,340, filed May 9, 2012, Sugano, et al.
U.S. Appl. No. 13/713,680, filed Dec. 13, 2012, Kondo, et al.

* cited by examiner

HYDRAULIC DRIVING APPARATUS FOR WORKING MACHINE

BACKGROUND OF THE INVENTION

1. Field of the Invention

The present invention relates to a hydraulic driving apparatus provided in a working machine, such as a crane, to drive a load, such as a suspended load, in the same direction as a self-weight falling direction, i.e., a direction along which the load falls by its self-weight.

2. Description of the Background Art

As an apparatus for driving a load in the same direction as a self-weight falling direction of the load, there is known, for example, a lowering drive apparatus for driving a winch which suspends a load by a wire rope, in a lowering direction. For this apparatus, it is important to prevent falling of a suspended load due to stalling of a winch motor caused by cavitation arising from a lowering in pressure on a meter-in side during a lowering drive mode.

As means to prevent such a reduction in pressure on the meter-in side, JP 2000-310201A discloses a technique of providing a so-called externally-pilot-operated counterbalance valve in a flow passage on a meter-out side. This externally-pilot-operated counterbalance valve is operable to narrow the flow passage on the meter-out side when the pressure on the meter-in side becomes equal to or less than a set pressure thereof to thereby prevent pressure on the meter-in side from its excessive lowering.

The externally-pilot-operated counterbalance, however, has a pressure measurement point and a pressure control point which are located on the meter-in side and on the meter-out side, respectively; in other words, it is subjected to control missing so-called co-location under the control theory in which positions of measurement and control points are different from each other, thus having a problem of being fundamentally unstable and likely to cause hunting.

As means to prevent the above hunting, there exists a technique of providing an orifice capable of giving large attenuation to a valve opening movement of the counterbalance valve, in a pilot fluid passage, however having a problem that the orifice prolongs a valve opening time of the counterbalance valve to thus deteriorate response of the counterbalance valve, and further generates a large flow resistance in the counterbalance valve until it is fully opened, to thereby cause an unnecessary boosted pressure.

As another technique for preventing the hunting, the JP 2000-310201A discloses a communication valve controlling fluid communication between the flow passage on the meter-in side and the flow passage on the meter-out side and a flow regulation valve controlling a meter-in flow rate so as to make a pressure difference between the two flow passages be smaller; however, this technique has difficulty in obtaining a stable lowering speed. Specifically, in a general lowering control circuit, there is generated a holding pressure corresponding to a weight of a suspended load, which makes a pressure difference between meter-out and meter-in sides be larger as the weight of the load becomes larger, this increase in the pressure difference involving an increase in an opening degree of the flow regulation valve on the meter-in side and thereby increasing the meter-in flow rate. In the above conventional apparatus, the lowering speed will be thus largely changed depending on the weight of the load.

SUMMARY OF THE INVENTION

It is an object of the present invention to provide a hydraulic driving apparatus for a working machine, capable of preventing an excessive lowering in pressure on a meter-in side and driving a load at a stable speed in a lowering direction which is a direction equal to a self-weight falling direction of the load, while involving no occurrence of hunting and large boosted pressure, that is, disadvantages in the conventional counterbalance valve.

Provided is a hydraulic driving apparatus for a working machine, designed to drive a load in a lowering direction equal to a self-weight falling direction of the load by means of hydraulic pressure, the hydraulic driving apparatus comprising: a hydraulic pump; a driving power source for driving the hydraulic pump to cause the hydraulic pump to discharge hydraulic fluid therefrom; a hydraulic actuator having a first port and a second port, the hydraulic actuator being adapted to drive the load in the lowering direction by receiving a supply of hydraulic fluid discharged from the hydraulic pump to the first port and discharging the hydraulic fluid from the second port; a manipulation device adapted to be manually operated to designate an operating speed of the hydraulic actuator; a hydraulic circuit for work including a meter-in flow passage for leading hydraulic fluid from the hydraulic pump into the first port of the hydraulic actuator during a mode for driving the load in the lowering direction, a meter-out flow passage for leading hydraulic fluid discharged from the second port of the hydraulic actuator into a tank during the mode for driving the load in the lowering direction, and a regeneration flow passage communicating the meter-out flow passage with the meter-in flow passage; a control valve for changing a state of the supply of the hydraulic fluid from the hydraulic pump to the hydraulic actuator so as to operate the hydraulic actuator at a speed designated by the manipulation device; a meter-out flow controller provided in the meter-out flow passage to adjust a meter-out flow rate, which is a flow rate of hydraulic fluid in a region of the meter-out flow passage upstream of a position where the regeneration flow passage is connected to the meter-out flow passage, to a flow rate corresponding to a speed designated by the manipulation device; a back pressure valve provided in the meter-out flow passage at a position downstream of the position where the regeneration flow passage is connected to the meter-out flow passage, to produce a predetermined back pressure; a check valve provided in the regeneration flow passage to limit a flow direction of hydraulic fluid in the regeneration flow passage to a direction from the meter-out flow passage to the meter-in flow passage; and a non-regeneration operation relief valve to determine an upper limit of the pressure of the meter-in flow passage by being opened, when a pressure of the meter-in flow passage becomes equal to or greater than a set pressure thereof, to let out the hydraulic fluid flowing through the meter-in flow passage to the tank. The set pressure of the non-regeneration operation relief valve is set to a value which is equal to or greater than a sum of a minimum value of a set pressure of the back pressure valve, an inlet-outlet pressure difference of the meter-out flow controller when the meter-out flow rate adjusted by the meter-out flow controller has a maximum value and a discharge flow rate of the hydraulic pump has a maximum value, and an inlet-outlet actuator pressure difference, that is, a difference between the inlet pressure and the outlet pressure of the hydraulic actuator, necessary to drive the hydraulic actuator with no load, and is set to a value equal to or greater than a maximum value of the set pressure of the back pressure valve. In the case where the set pressure of the back pressure valve is fixed, the maximum value and the minimum value of the set pressure are, of course, identical.

DESCRIPTION OF THE PREFERRED EMBODIMENTS

Figure 1:
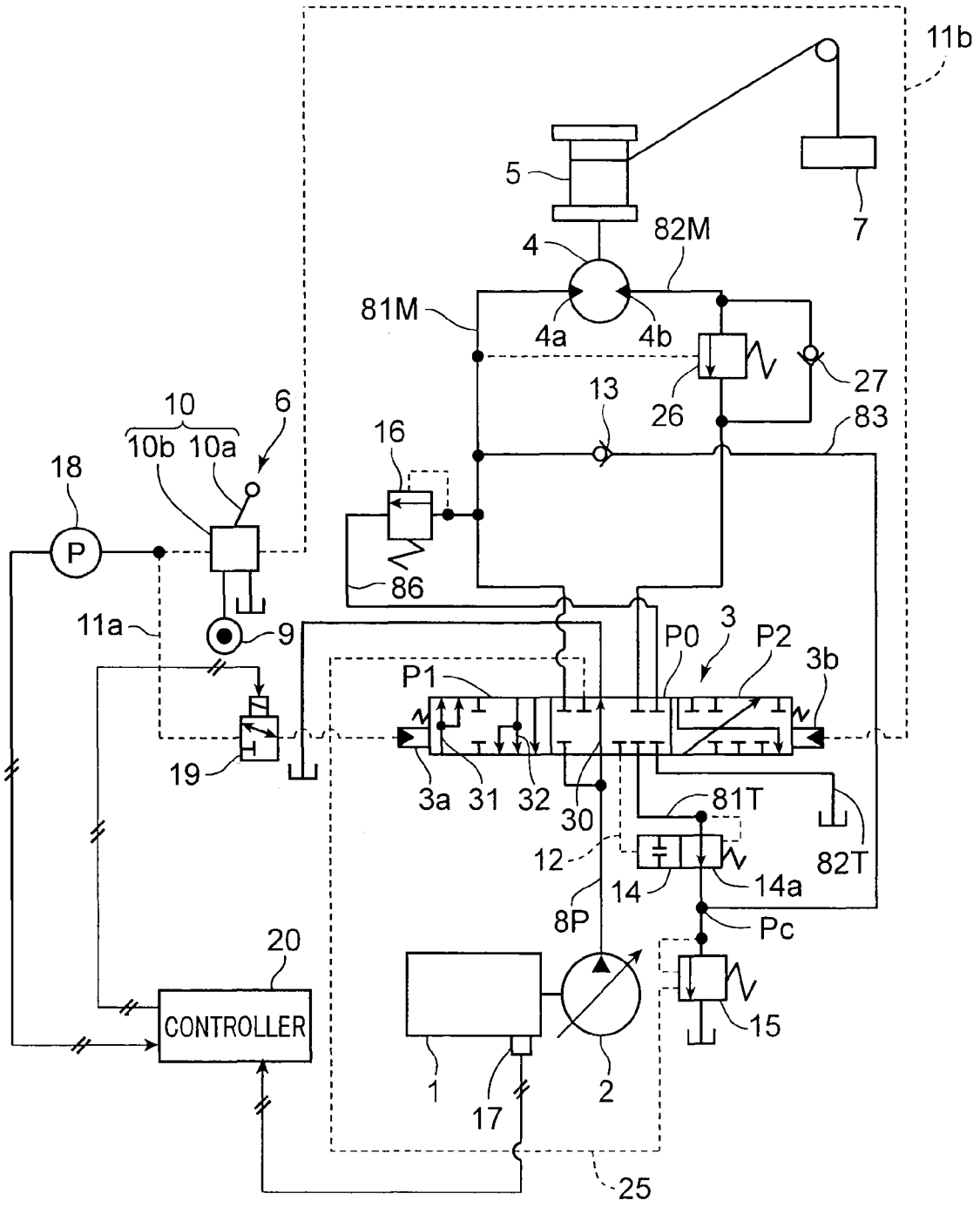
FIG. 1 is a circuit diagram showing a hydraulic driving apparatus for a working machine, according to a first embodiment of the present invention.
Figure 2:
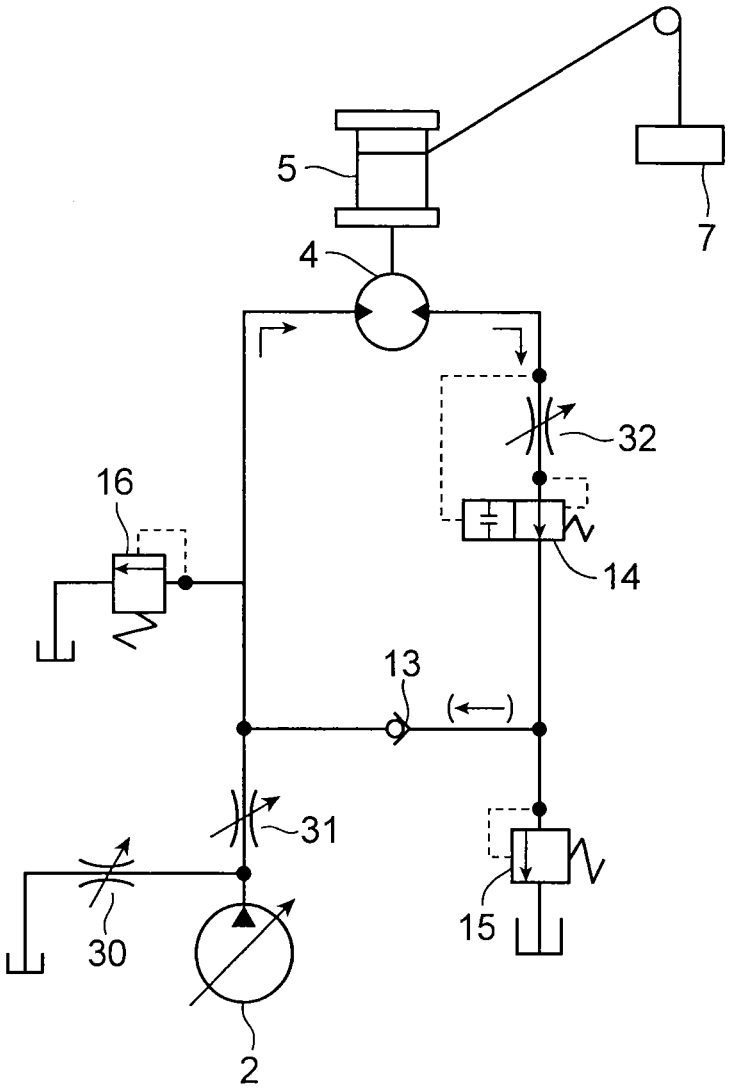
FIG. 2 is a circuit diagram schematically showing a substantial part of the apparatus shown in FIG. 1.

There will be described a first embodiment of the present invention with reference to FIGS. 1 to 4. FIG. 1 is a circuit diagram showing an overall configuration of a hydraulic driving apparatus according to the first embodiment. FIG. 2 schematically shows a substantial part of the apparatus, particularly briefly showing a flow of hydraulic fluid during a lowering drive mode. The following description will be made primarily with reference to FIG. 1.

The apparatus comprises an engine 1, a hydraulic pump 2, a hydraulic motor 4, a hydraulic circuit for work, a manipulation device 6 for manipulating a rotational speed of the hydraulic motor 4, a direction selector valve 3, a meter-out flow regulation valve 14, a back pressure valve 15, a check valve 13, and a low-pressure relief valve 16 serving as a non-regeneration operation relief valve.

The engine 1 serves as a driving power source for the hydraulic pump 2, provided with an engine speed sensor 17 as a rotation detecting device to detect an engine speed, i.e., a rotational speed of the engine 1. The hydraulic pump 2 is driven by the engine 1 to thereby discharge hydraulic fluid in a tank therefrom. In this embodiment, used is a variable displacement hydraulic pump as the hydraulic pump 2.

The hydraulic motor 4, which is one example of "hydraulic actuator" included in the appended claims, is incorporated in a winch unit having a winch drum 5, to rotate the winch drum 5 in both forward and reverse directions to raise and lower a load, namely, a suspended load 7 in this embodiment. Specifically, the hydraulic motor 4 has a first port 4*a* and a second port 4*b*. When hydraulic fluid is supplied to the first port 4*a*, the hydraulic motor 4 rotates the winch drum 5 in a lowering direction, i.e., in a direction for causing the suspended load 7 to be lowered, and then discharge the hydraulic fluid from the second port 4*b*; when hydraulic fluid is supplied to the second port 4*b*, the hydraulic motor 4 rotates the winch drum 5 in a raising direction, i.e., in a direction for causing the suspended load 7 to be raised, and then discharge the hydraulic fluid from the first port 4*a*.

The hydraulic circuit for work is to supply and discharge hydraulic fluid (discharged from the hydraulic pump) to and from the hydraulic motor 4, respectively. For forming this circuit, hydraulic lines including the following are used: a pump hydraulic line 8P connecting a discharge port of the hydraulic pump 2 to the direction selector valve 3; the first motor hydraulic line 81M connecting the direction selector valve 3 to the first port 4*a* of the hydraulic motor 4; the second motor hydraulic line 82M connecting the direction selector valve 3 to the second port 4*b* of the hydraulic motor 4; the first tank hydraulic line 81T and the second tank hydraulic line 82T arranged in parallel to each other and each connecting the direction selector valve 3 to the tank; a regeneration hydraulic line 83 interconnecting the first tank hydraulic line 81T and the first motor hydraulic line 81M; and a relief hydraulic line 86 branching from a midway point of the first motor hydraulic line 81M and reaching the direction selector valve 3.

The direction selector valve 3, interposed between the hydraulic pump 2 and the hydraulic motor 4, changes a drive mode of the winch 5 between a lowering drive mode and a raising drive mode depending on a manual operation state of the manipulation device 6. The direction selector valve 3 in this embodiment is composed of a pilot-operated three-position selector valve having a lowering-side pilot port 3*a* and a raising-side pilot port 3*b*, and designed to: be held in a neutral position P0 when no pilot pressure is supplied to either of the two pilot ports 3*a* and 3*b*; be opened from the neutral position P0 to a lowering drive position P1 by a stroke corresponding to the magnitude of the pilot pressure when a pilot pressure is supplied to the lowering-side pilot port 3*a*; and be moved from the neutral position P0 to a raising drive position P2 by a stroke corresponding to magnitude of the pilot pressure when a pilot pressure is supplied to the raising-side pilot port 3*b*.

In each of the three positions, the direction selector valve 3 forms the following flow passage.

(i) In the neutral position P0, the direction selector valve 3 blocks the supply of the hydraulic fluid discharged from the hydraulic pump 2 to the hydraulic motor 4 while forming a bleed-off flow passage for leading the hydraulic fluid directly into the tank. Furthermore, in the neutral position P0, the direction selector valve 3 has a bleed-off orifice 30 for determining a bleed-off flow rate, the bleed-off orifice 30 having an opening area Abo which is reduced as the position of the direction selector valve 3 is away from the neutral position P0.

(ii) In the lowering drive position P1, the direction selector valve 3 interconnects the pump hydraulic line 8P and the first motor hydraulic line 81M to thereby open up a flow passage for leading hydraulic fluid discharged from the hydraulic pump 2 to the first port 4*a* of the hydraulic motor 4, i.e., a "meter-in flow passage" during the lowering drive mode, while interconnecting the second motor hydraulic line 82M and the first tank hydraulic line 81T to thereby open up a flow passage for returning hydraulic fluid discharged from the second port 4*b* of the hydraulic motor 4 to the tank, i.e., a "meter-out flow passage", during the lowering drive mode. Besides, the direction selector valve 3 connects the relief hydraulic line 86 to the second tank hydraulic line 82T. Furthermore, in the lowering drive position P1, the direction selector valve 3 has a meter-in orifice 31 for determining a meter-in flow rate which is a flow rate of hydraulic fluid in the meter-in flow passage and a meter-out orifice 32 for determining a meter-out flow rate which is a flow rate of hydraulic fluid in the meter-out flow passage, each of the meter-in and meter-out orifice 31, 32 having an opening area (Ami, Amo), both of which are increased as the stroke from the neutral position P0 is increased.

(iii) In the raising drive position P2, the direction selector valve 3 connects the pump hydraulic line 8P to the second motor hydraulic line 82M to thereby form a flow passage for leading the hydraulic fluid discharged from the hydraulic pump 2 to the second port 4*b* of the hydraulic motor 4, while connecting the first motor hydraulic line 81M to the second tank hydraulic line 82T to thereby form a flow passage for returning the hydraulic fluid discharged from the first port 4*a* of the hydraulic motor 4 to the tank.

The manipulation device 6 comprises a pilot hydraulic pressure source 9 and a remote-control valve unit 10. The remote-control valve unit 10 is interposed between the pilot hydraulic pressure source 9 and each of the two pilot ports 3*a*, 3*b* of the direction selector valve 3. The remote-control valve unit 10 includes a manipulation lever 10*a* adapted to be manually operated by an operator and a main body valve 10*b* connected to the manipulation lever 10*a*. The main body valve 10*b* has a lowing-side output port and a raising-side output port which are connected to the lowering-side pilot port 3*a* and the raising-side pilot port 3*b* of the direction selector valve 3 through a lowering-side pilot line 11*a* and a raising-side pilot line 11*b*, respectively. The remote-control valve 10*b* is adapted to interlock with the manipulation lever 10*a* so as to output a pilot pressure having a value corresponding to an amount of the operation (operation amount) of the manipulation lever 10*a*, from one of the output ports corresponding to a direction of the operation (operation direction) of the manipulation lever 10*a*, and input the pilot pressure into one of the pilot ports 3*a*, 3*b* of the direction selector valve 3 corresponding to the output port.

Figure 3A:
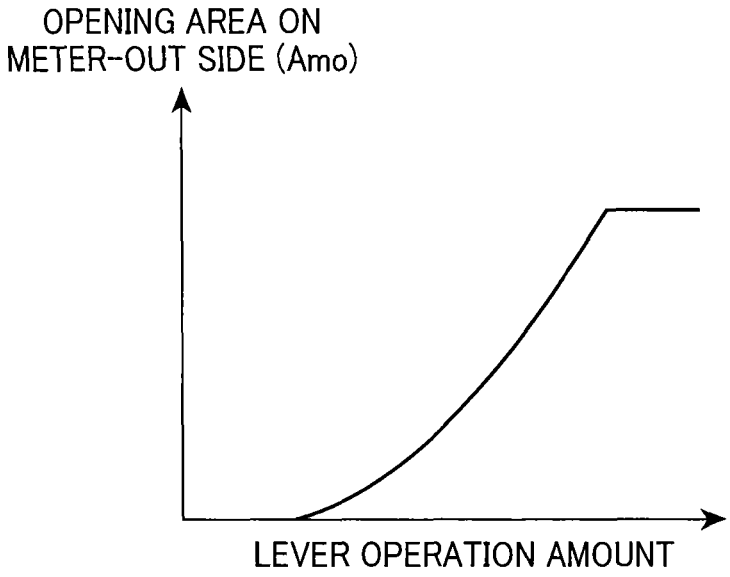
FIG. 3A is a graph showing a relationship between a lever operation amount of a remote control valve and an opening area of a meter-out orifice associated with a meter-out flow controller, in the apparatus shown in FIG. 1.
Figure 4A:
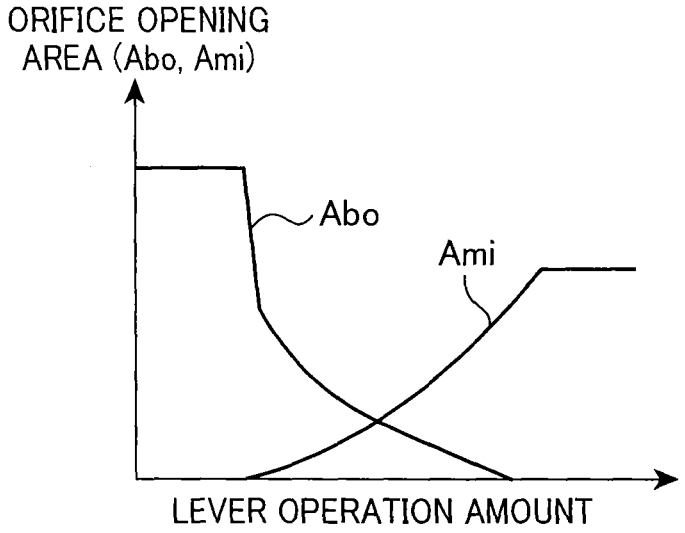
FIG. 4A is a graph showing a relationship between the lever operation amount and each of respective opening areas of a bleed-off orifice and a meter-in orifice.
Figure 4B:
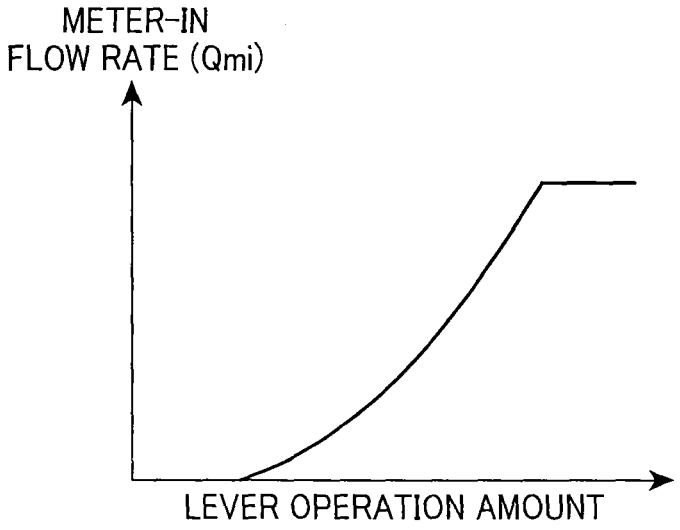
FIG. 4B is a graph showing a relationship between the lever operation amount and a meter-in flow rate.

Since the stroke of the direction selector valve 3 from the neutral position P0 toward the lowering drive position P1 or the raising drive position P2 is increased, as described above, corresponding to the value of the pilot pressure to be input into the direction selector valve 3, an operator can change the operation direction and stroke of the direction selector valve 3 through the manual operation of the manipulation lever 10*a* to thereby change the opening areas Abo, Ami, Amo of the orifices 30, 31, 32. Specifically, FIG. 3A shows a relationship between the operation amount (for the lowering drive mode) of the manipulation lever 10*a* and the opening area Amo of the meter-out orifice 32, and FIG. 4A shows a relationship between the operation amount (for the lowering drive mode) of the manipulation lever 10*a* and each of the opening areas Abo, Ami of the bleed-off orifice 30 and the meter-in orifice 31. The direction selector valve 3 thus functions as a control valve which changes a state of the supply of hydraulic fluid from the hydraulic pump 2 to the hydraulic motor 4 so as to cause the hydraulic motor 4 to be driven at a speed designated by the manipulation device 6.

The meter-out flow regulation valve 14 is provided, in the first tank hydraulic line 81T forming the meter-out flow passage during the lowering drive mode, upstream of a connection position Pc at which the regeneration hydraulic line 83 is connected to the first tank hydraulic line 81T to constitute, in cooperation with the meter-out orifice 32, a meter-out flow controller for adjusting the meter-out flow rate Qmo to a flow rate corresponding to a speed designated by the manipulation device 6.

The meter-out flow regulation valve 14 has a valve body capable of being opened and closed and a spring 14*a* biasing the valve body toward a valve opening position, and is adapted to be opened and closed so as to make an inlet-outlet pressure difference of the meter-out orifice 32, i.e., a difference between respective pressures on upstream and downstream sides of the meter-out orifice 32, to be in agreement with a pressure difference set value which is set by a spring force of the spring 14*a*. Specifically, the pressure on the upstream side of the meter-out orifice 32 is input into a valve closing-side port of the meter-out flow regulation valve 14 through an fluid passage formed within the direction selector valve 3 and a hydraulic line 12, while the pressure on the downstream side of the meter-out orifice 32 is introduced into the meter-out flow regulation valve 14 as a pressure for opening the meter-out flow regulation valve 14 in cooperation with the spring force of the spring 14*a*.

Alternatively, the meter-out flow regulation valve 14, in the present invention, may be provided on an upstream side of the meter-out orifice 32.

Figure 9:
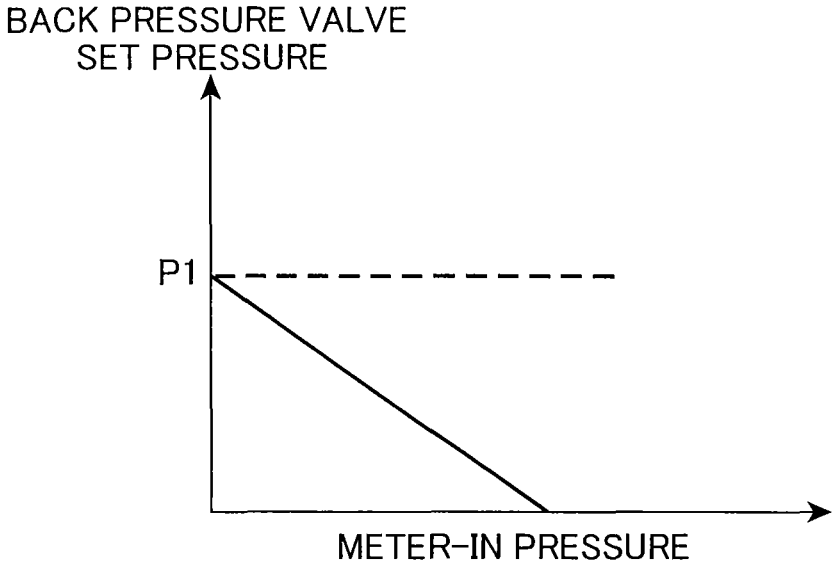
FIG. 9 is a graph showing a relationship between a meter-in pressure and a set pressure of a back pressure valve, in the apparatus shown in FIG. 1.
Figure 10:
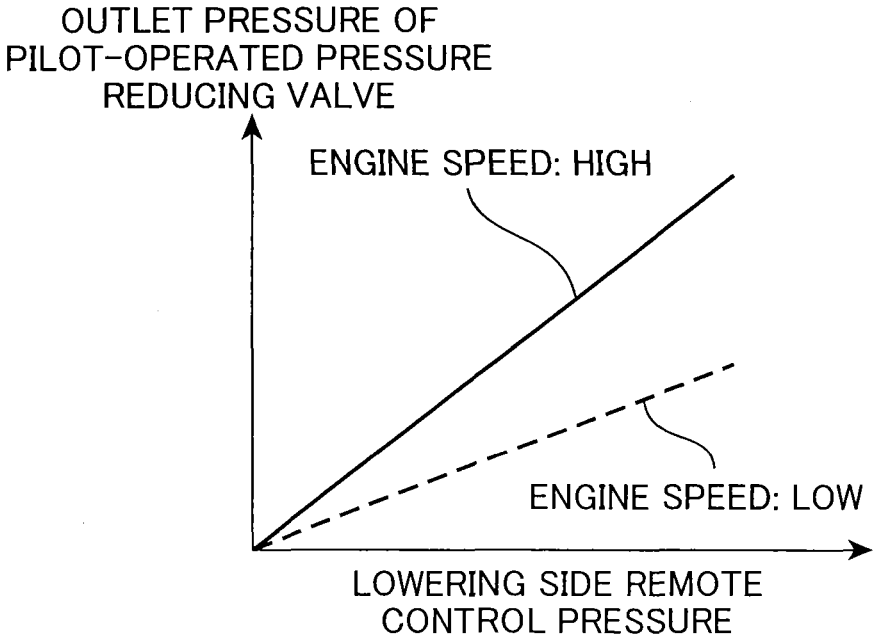
FIG. 10 is a graph showing a relationship between a remote-control pressure for a lowering drive mode and an outlet pressure of a solenoid-operated pressure reducing valve controlled by a controller, in two cases where an engine speed is set to a relatively high value and a relatively low value, in the apparatus shown in FIG. 1.

The back pressure valve 15, provided in the first tank hydraulic line 81T forming the meter-out flow passage during the lowering drive mode at a position downstream of the connection position Pc of the regeneration hydraulic line 83, is a pressure control valve for generating a back pressure equal to a set pressure thereof. The set pressure of the back pressure valve 15, though being permitted to be kept constant as indicated by the broken line in FIG. 9, is preferably reduced as the meter-in pressure, i.e., pressure of the meter-in flow passage during the lowering drive mode, is increased as indicated by the solid line in the same figure. To thus control the back pressure, this embodiment includes an fluid passage 25 to lead a pressure on a downstream side of the meter-in orifice 31 of the direction selector valve 3, i.e., a pressure of the meter-in flow passage during the lowering drive mode, to the back pressure valve 15 as a pilot pressure acting in a valve opening direction. This introduction of the pilot pressure causes the set pressure of the back pressure 15 to be substantially reduced.

The regeneration hydraulic line 83 forms a regeneration flow passage for supplemental supply of a part of the hydraulic fluid on the side of the meter-out flow passage (hydraulic fluid having passed through the meter-out flow regulation valve 14) from a position upstream of the back pressure valve 15 to the meter-in flow passage, in the case of the meter-in flow rate less than the meter-out flow rate (a flow rate having been already adjusted by the meter-out flow regulation valve 14) during the lowering drive mode. The check valve 13, provided in a midway point of the regeneration hydraulic line 83, limits a flow direction of the hydraulic fluid in the regeneration hydraulic line 83 to a direction from the meter-out flow passage to the meter-in flow passage.

The low-pressure relief valve 16, provided in a midway point of the relief hydraulic line 86, functions as a non-regeneration operation relief valve which is opened, when the meter-in pressure (specifically, a pressure of the first motor hydraulic line 81M constituting the meter-in flow passage during the lowering drive mode) becomes equal to or greater than a set pressure Prs thereof, to let out hydraulic fluid flowing through the meter-in flow passage to the tank and thereby determines an upper limit of the meter-in pressure. The set pressure Prs of the low-pressure relief valve 16 is set to a value satisfying the following conditions (1) and (2): (1) the value is equal to or greater than a sum (Psum) of: (a) a minimum value of a set pressure of the back pressure valve 16; (b) an inlet-outlet pressure difference of the meter-out flow controller when the meter-out flow rate adjusted by the meter-out flow controller has a maximum value and a discharge flow rate of the hydraulic pump 2 has a maximum value; and (c) an motor pressure difference, that is, a pressure difference between the first port 4*a* and the second port 4*b*, necessary to drive the hydraulic motor 4 with no load; and (2) the value is equal to or greater than a maximum value of the set pressure of the back pressure valve.

It is preferable to set the set pressure Prs of the low-pressure relief valve 16 to the lowest possible pressure in a range satisfying the above two conditions. Specifically, it is preferably set to a value which is equal to or greater than the sum (Psum) and equal to or less than 1.1 times of the sum (Psum≤Prs≤1.1 Psum).

Moreover, in this embodiment, there is additionally provided means for reducing the meter-out flow rate along with a reduction in the engine speed to enable the suspended load 7 to be finely manipulated. Specifically, a remote-control pressure sensor 18 and a pilot pressure reducing valve 19 are provided in the lowering pilot line 11*a* interconnecting the remote-control valve unit 10 and the lowering-side pilot port 3*a* of the direction selector valve 3, both connected to a controller 20.

The remote-control pressure sensor 18 detects a lowering-side remote-control pressure output from the remote-control valve unit 10 and input a resulting detection signal into the controller 20. The pilot pressure reducing valve 19, in this embodiment, is composed of a solenoid-operated proportional pressure reducing valve, which is operable to reduce the remote-control pressure output from the remote-control valve unit 10 to a value corresponding to an instruction signal input from the controller 20, and input the reduced pressure into the lowering-side pilot port 3*a* as a lowering pilot pressure.

The controller 20 is operable to output, to the pilot pressure reducing valve 19, an instruction signal to make the instructing the pilot pressure reducing valve 19 reduce the pilot pressure corresponding to the remote-control pressure as the engine speed becomes lower, based on the remote-control pressure detected by the remote-control pressure sensor 18 and the engine speed detected by the engine speed sensor 17. In other words, the controller 20 functions as a pressure-reducing-valve control device which reduces an outlet pressure of the pilot pressure reducing valve 19, namely, the pilot pressure, as the engine speed detected by the engine speed sensor 17 becomes lower. Furthermore, the controller 20 constitutes, in cooperation with the pilot pressure reducing valve 19, meter-out flow rate reducing means which reduces the meter-out flow rate to be adjusted by the meter-out flow controller in response to the manipulation device 6, as the engine speed becomes lower.

The "rotation detecting device" included in the present invention is not limited to the engine speed sensor 17 but may be a pump speed sensor operable to detect a rotational speed (pump speed) of the hydraulic pump 2.

Besides, this embodiment includes a pilot-operated safety valve 26 and a check valve 27 which are provided in the second motor hydraulic line 82M forming the meter-out flow passage during the lowering drive mode, in parallel with each other. The pressure of the first motor hydraulic line 81M is input, as a pilot pressure, into the pilot-operated safety valve 26, which is adapted to be closed only when the pilot pressure, i.e., the meter-in pressure during the lowering drive mode, becomes equal to or less than a predetermined set pressure thereof. In other words, the pilot-operated safety valve 26 is adapted to be opened at a time when the meter-in pressure has become greater than the set pressure. The set pressure of the pilot-operated safety valve 26 is set to a value slightly higher than the maximum pressure of the back pressure valve 15. Meahwhile, the check valve 27 is adapted to be opened only when the hydraulic fluid in the second motor hydraulic line 82M flows in a direction from the direction selector valve 3 toward the second port 4*b* of the hydraulic motor 4, that is, only during the raising drive mode.

Next will be described the action of the apparatus according to the first embodiment.

Upon manual operation of the manipulation lever 10*a* of the remote-control valve unit 10 in a direction for raising, the remote-control pressure output from the remote-control valve 10 is input into the raising-side pilot port 3*b* of the direction selector valve 3 to open the direction selector valve 3 from the neutral position P0 to the raising drive position P2. The hydraulic fluid discharged from the hydraulic pump 2 is thereby supplied to the second port 4*b* of the hydraulic motor 4 via the check valve 27 of the second motor hydraulic line 82M to rotate the hydraulic motor 4 in the raising direction. The hydraulic fluid discharged from the first port 4*a* of the hydraulic motor 4 is returned to the tank through the first motor hydraulic line 81M and the second tank hydraulic line 82T.

On the other hand, upon the manual operation of the manipulation lever 10*a* of the remote-control valve unit 10 in a direction for lowering, the direction selector valve 3 is opened from the neutral position P0 to the lowering drive position P1. Specifically, a pilot pressure having a value corresponding to the operation amount of the manipulation lever 10*a* is supplied from the remote-control valve 10 to the direction selector valve 3 through the lowering pilot line 11*a* to move the direction selector valve 3 toward the lowering drive position P1 by a stroke corresponding to the magnitude of the pilot pressure. This movement involves a reduction in the opening area Abo of the bleed-off orifice and an increase in the opening area Ami of the meter-in orifice, as shown in FIG. 4A, thereby increasing the meter-in flow rate, that is, a flow rate of the hydraulic fluid supplied from the hydraulic pump 2 to the first port 4*a* of the hydraulic motor 4. This causes the hydraulic motor 4 to be rotated in the lowering direction, and discharge the hydraulic fluid from the second port 4*b*. The discharged hydraulic fluid is returned to the tank through the meter-out flow passage, that is, through the direction selector valve 3, the meter-out flow regulation valve 14 and the back pressure valve 15.

In place of the bleed-off orifice 30 may be provided a meter-in flow controller which is operable to let out, when a flow rate of hydraulic fluid passing through the meter-in orifice 31 becomes equal to or greater than a predetermined value, the excess thereof into the tank.

Figure 3B:
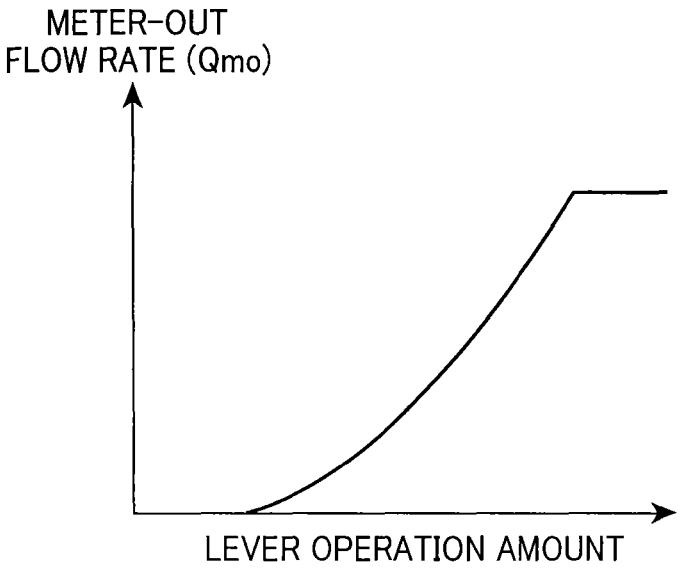
FIG. 3B is a graph showing a relationship between the lever operation amount and a meter-out flow rate adjusted by the meter-out flow controller.

On the other hand, the opening area Amo of the meter-out orifice 32 of the direction selector valve 3 is changed corresponding to the operation amount of the manipulation lever 10*a* as shown in FIG. 3A, and, along with this, the meter-out flow controller composed of the meter-out orifice 32 and the meter-out flow regulation valve 14 controls the meter-out flow rate Qmo as shown in FIG. 3B. In detail, the meter-out flow regulation valve 14 is opened to make an inlet-outlet pressure difference of the meter-out orifice 32 be a predetermined value ΔPmo, thereby controlling the meter-out flow rate Qmo as represented by the following formula (I), i.e., as shown in FIG. 3B:

$$Qmo = Cv \times Amo \times \sqrt{(\Delta Pmo)} \quad (1),$$

wherein Cv is a flow coefficient.

While the meter-out flow rate Qmo is thus controlled, the lowering is performed at a speed corresponding to the manipulation lever 10*a*, regardless of a magnitude of load (in this embodiment, a weight of the suspended load 7). In other words, the meter-out flow controller controls the meter-out flow rate depending solely on the operation amount of the manipulation lever 10*a*, regardless of a change in weight of the suspended load 7 as a load. Hence, differently from the conventional apparatus, the apparatus according to the embodiment can effectively suppresses a change in speed of a hydraulic actuator due to an increase/reduction in weight of a load, which contributes to improved manipulation and safety.

Besides, in the case where the meter-in flow rate Qmi is less than the meter-out flow rate Qmo, that is, Qmi<Qmo, during the lowering drive mode, the apparatus according to the first embodiment allows a shortage in the meter-in flow rate Qmi (Qmo−Qmi) to be supplemented from the connection point Pc on the upstream side of the back pressure valve 15 to the first motor hydraulic line 81M forming the meter-in flow passage, through the regeneration hydraulic line 83. During this process, the pressure on the upstream side of the back pressure valve 15 is equal to or greater than the set pressure of the back pressure valve 15 (the increase in the passing flow rate of the back pressure valve 15 increases the pressure by an overridden part of the hydraulic fluid), so that the meter-in pressure becomes also equal to or greater than a value obtained by subtracting a pressure loss of the regeneration flow passage from the set pressure of the back pressure valve 15. This prevents the meter-in pressure from an excessive reduction which can generate cavitation.

On the other hand, in the case of the meter-in flow rate Qmi>the meter-out flow rate Qmo, the supplementation through the regeneration flow passage 83 is not performed, but, on contrary, the excess in the meter-in flow rate Qmi, that is, Qmi−Qmo, is let out to the tank through the low-pressure relief valve 16 as the non-regeneration operation relief valve. Specifically, the low-pressure relief valve 16 is opened at a time when the meter-in pressure corresponding to the meter-in flow rate Qmi has become equal to or greater than a set pressure of the low-pressure relief valve 16, thus determining the meter-in pressure to a value equal to or slightly greater than the set pressure of the low-pressure relief valve 16 (the increase in the passing flow rate in the low-pressure relief valve 16 increases the meter-in pressure by an overridden part of the hydraulic fluid).

In both of the cases of the meter-in flow rate Qmi>the meter-out flow rate Qmo and the meter-in flow rate Qmi<the meter-out flow rate Qmo, the meter-in pressure is thus kept at a value which is equal to or slightly greater than the set pressure of the low-pressure relief valve 16 as the non-regeneration operation relief valve or a value equal to or slightly greater than the set pressure of the back pressure valve 15, which prevents cavitation due to a reduction in the meter-in pressure. Although a perfect agreement between the meter-in flow rate Qmi and the meter-out flow rate Qmo may cause neither the supplementation of hydraulic fluid to the meter-in flow passage via the regeneration flow passage nor the valve opening of the low-pressure relief valve 16, such a perfect agreement is hardly caused or short-lived, thus practically producing no trouble. Even if this situation is continued, there is no possibility of cavitation in the meter-in flow passage, because of maintaining the adequate balance between supply and drainage with respect to the hydraulic motor 4.

Although there has been known a technique with use of a counterbalance valve to preventing such cavitation, the use thereof involves a disadvantage, such as hunting in the meter-in pressure or pronounced boosted pressure. In contrast, the apparatus according to the first embodiment can prevent the cavitation with no use of a counterbalance valve involving the above disadvantage.

Figure 5:
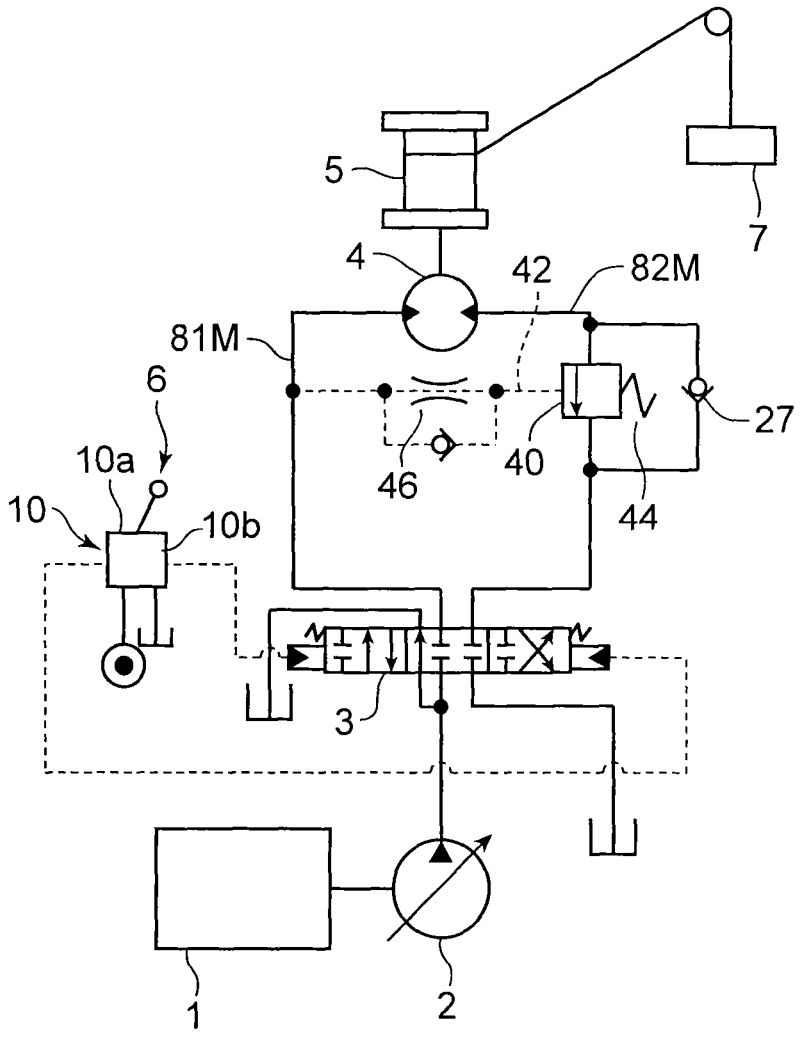
FIG. 5 is a circuit diagram of a hydraulic driving apparatus as a comparative example.

The superiority of the apparatus according to the first embodiment on the point will be more specifically described based on a comparison with an apparatus shown in FIG. 5 as a comparative example. The apparatus shown in FIG. 5, while including the engine 1, the hydraulic pump 2, the hydraulic motor 4, the manipulation device 6, and the first and second motor hydraulic line 81M, 82M, as with the apparatus shown in FIG. 1, further comprises an externally-pilot-operated counterbalance valve 40, in place of the regeneration flow passage, the meter-out flow controller, the back pressure valve 15 and the low-pressure relief valve 16 which are comprised in the apparatus shown in FIG. 1. Into the counterbalance valve 40 is introduced a pressure in the first motor hydraulic line 81M constituting the meter-in flow passage during the lowering drive mode, namely, the meter-in pressure, through a flow passage 42 as a pilot pressure. The counterbalance valve 40 has a spring 44 which determines a set pressure Pcb thereof, and is adapted to be closed when the pilot pressure input into the counterbalance valve 40, i.e., the meter-in pressure, is less than the set pressure Pcb, while opened when the meter-in pressure is equal to or greater than the set pressure Pcb.

The counterbalance valve 40 also can prevent cavitation due to a shortage in the meter-in flow rate. For example, when the rotational speed of the hydraulic motor 4 is increased due to the weight of the suspended load 7 to thereby cause the flow rate adsorbed by the hydraulic motor 4 to exceed a supply flow rate from the hydraulic pump 2, the meter-in pressure is reduced, but the counterbalance valve 40 is moved in a valve closing direction when the meter-in pressure reduced to the set pressure Pcb of the counterbalance valve 40, thus throttling the meter-out flow passage and thereby applying braking force to the hydraulic motor 4. This restricts the flow rate adsorbed by the hydraulic motor 4 to thus establish a control to keep the meter-in pressure at a value equal to or greater than the set pressure Pcb.

Figure 6A:
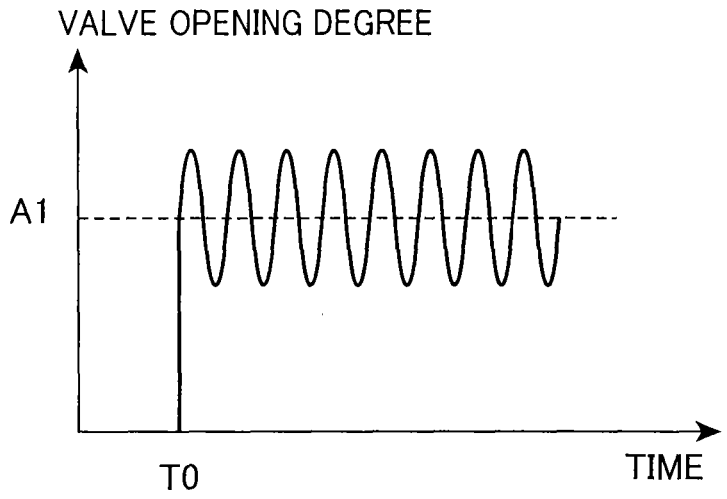
FIGS. 6A and 6B are graphs showing respective hunting in opening degree of a counterbalance valve and hunting in meter-in pressure, which are possibly caused in the apparatus shown in FIG. 5.
Figure 6B:
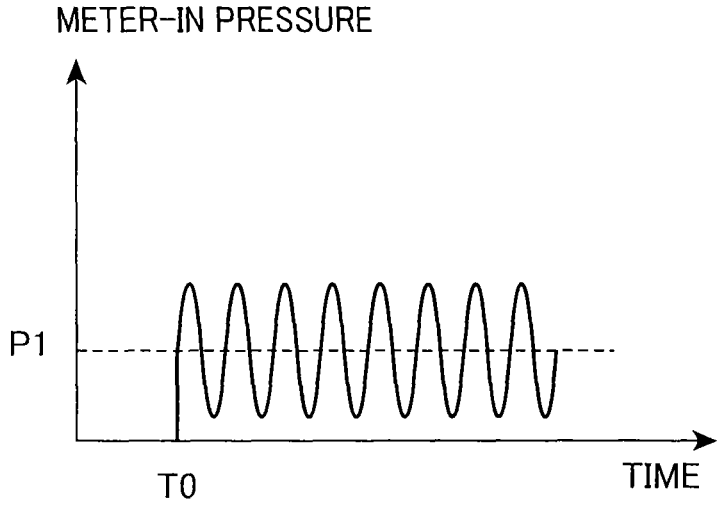

However, this control by use of the counterbalance valve 40, where a measurement point is located on the meter-in flow passage whereas a control point is located on the meter-out flow passage, lacks co-location under control theory and is unstable. In other words, the positional difference between the measurement point and the control point makes the control unstable, thus permitting hunting to easily occur. Specifically, in the case of manually operating the manipulation lever 10*a* of the remote-control valve unit 10 in the manipulation device 6 from the neutral position in the direction for lowering at the time T0, there occurs hunting in opening degree of the counterbalance valve 40 as shown in FIG. 6A, which can oscillate the meter-in pressure as shown in FIG. 6B to make the rotational speed of the hydraulic motor 4 or the winch 5 unstable.

Figure 7A:
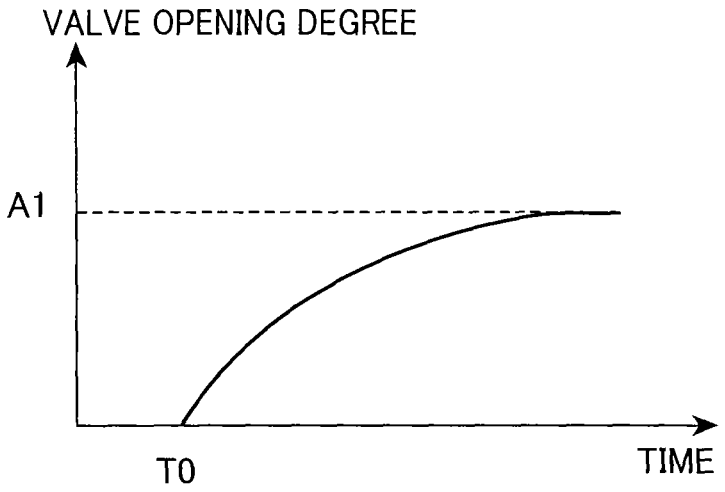
FIG. 7A is a graph showing a temporal change in valve opening degree immediately after the valve opening of the counterbalance valve.
Figure 7B:
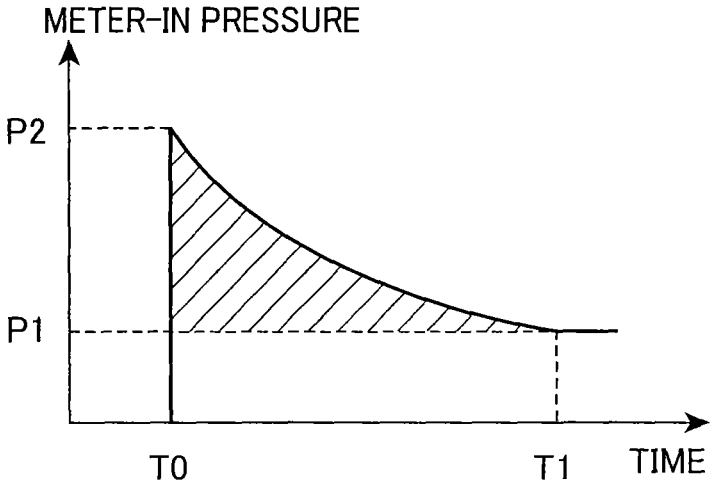
FIG. 7B is a graph showing a temporal change in meter-in pressure along with the change in valve opening degree.

As means to suppress such hunting, typically conceivable is to provide an orifice 46 in a midway point of the pilot flow passage 42 as shown in FIG. 5; however, as shown in FIG. 7A, the orifice 46 causes a significant response lag from the time T0 when the manual operation of the manipulation lever 10*a* is started to a time when the opening degree of the counterbalance valve 40 reaches an adequate value A1. Moreover, since there occurs a large pressure loss in the counterbalance valve 40 until sufficient opening thereof, as shown in FIG. 7B, during the period from the manual operation start time T0 through until the predetermined time T1, there is continued a situation where the meter-in pressure is greater than the set pressure Pcb, that is, where there occurs an unnecessary boosted pressure indicated by the hatched line in FIG. 7B, which causes a disadvantage of significant deterioration in operation efficiency.

Figure 8A:
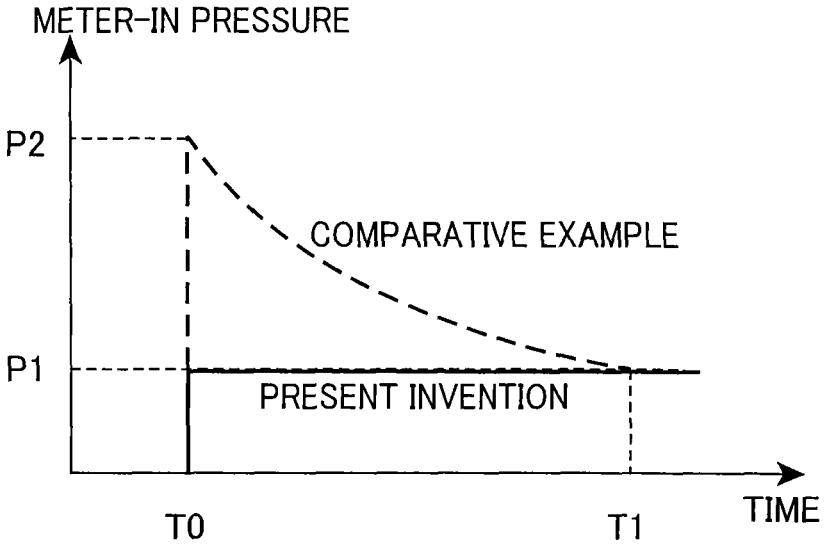
FIG. 8A is a graph showing a temporal change in meter-in pressure, in each of the apparatus shown in FIG. 1 and the apparatus shown in FIG. 5.
Figure 8B:
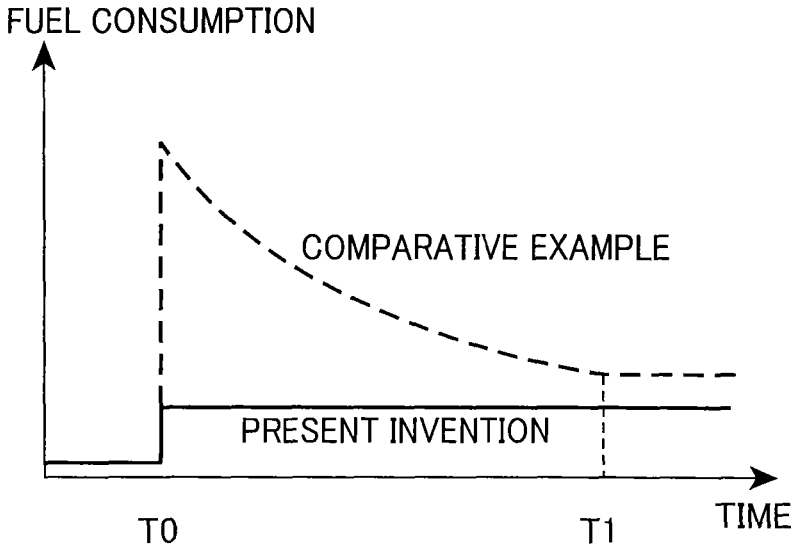
FIG. 8B is a graph showing a temporal change in fuel consumption, in each of the apparatus shown in FIG. 1 and the apparatus shown in FIG. 5.

In contrast, the meter-out flow controller used in the apparatus shown in FIG. 1, which adjusts the meter-out flow rate based on the inlet-outlet pressure difference of the meter-out orifice and has a measurement point and a control point both of which are located on the meter-out flow passage, establishes control-theoretical co-location and is thus able to perform stable control. Similarly to this, the back pressure valve 15 is also less likely to cause hunting. Hence, there is no need for adding an orifice to prevent the hunting and no occurrence of the pronounced boosted pressure as shown in FIG. 7B. Accordingly, as indicated by the solid line (the apparatus shown in FIG. 1) and the broken line (the apparatus shown in FIG. 5) in FIG. 8A, the meter-in pressure is effectively suppressed, and a power required for driving the hydraulic pump 2 is thereby significantly reduced, resulting in significantly improved fuel consumption of the engine as shown in FIG. 8B.

The apparatus shown in FIG. 1 is provided with the externally-pilot-operated safety valve 26 at a position corresponding to an installation position of the counterbalance valve 40 shown in FIG. 5; however, the safety valve 26 is one for ensuring safety in the event of a freak accident such as damage to a hydraulic line, and is therefore totally different from the counterbalance valve 40 in an intended purpose and a set pressure. The set pressure of the safety valve 26 is set to a value slightly greater than the set pressure of the back pressure valve 15; therefore, the safety valve 26 is opened immediately after the start of the lowering drive mode, and then kept opened during normal operation. However, when the meter-in pressure becomes less than the set pressure of the safety valve 26 due to the occurrence of a trouble, such as breakage of a hydraulic line constituting the meter-in flow passage, the safety valve 26 is closed to urgently stop the hydraulic motor 4, thereby ensuring safety. The present invention is intended to encompass an apparatus having such a safety valve 26.

In the present invention, the set pressure of the back pressure valve may be kept constant, but, in the apparatus shown in FIG. 1, the meter-in pressure is input into the back pressure valve 15 through the fluid passage 25 in addition to an inlet pressure of the back pressure valve 15 to serve as a pilot pressure acting in the valve opening direction, and the set pressure of the back pressure valve 15 is reduced by a value corresponding to the pilot pressure, that is, the set pressure of the back pressure valve 15 is reduced as the meter-in pressure is raised. This effectively suppresses a pressure loss caused by keeping the set pressure unduly high. For example, in the case of the meter-in flow rate Qmi>the meter-out flow rate Qmo, where no supplementation of hydraulic fluid to the meter-in flow passage through the regeneration passage is performed as mentioned above, there is no need for raising a high back pressure by use of the back pressure valve 15 to perform the supplementation, and, on the contrary, such a high back pressure may cause an increase in circuit pressure, thus generating a possibility of increasing driving power for the hydraulic pump and deteriorating fuel economy during the raising drive mode. Differently, in the apparatus shown in FIG. 1, when the meter-in flow rate Qmi>the meter-out flow rate Qmo, the set pressure of the back pressure valve 15 is so reduced by a value corresponding to an increase in the meter-in pressure that the pressure loss in the back pressure valve 15 is kept low and thus the increase in driving power for the hydraulic pump and the deterioration in fuel economy are effectively suppressed.

As the back pressure valve 15, there may be used an orifice having an opening degree which is increased as the operation amount of the manipulation lever 10*a* is increased. In this case, it is preferable that an opening area Abk of the orifice is set so as to be changed as follows:

$$Abk = \frac{Qbk}{Cv\sqrt{\Delta Pbk}}, \tag{2}$$

wherein: Cv is a flow coefficient; ΔPbk is the set pressure of the back pressure valve; and Qbk is a flow rate of hydraulic fluid passing through the back pressure valve, agreeing with the meter-in flow rate Qmi because of flow balance therebetween.

On the other hand, the set pressure of the low-pressure relief valve 16 is set to a value which is equal to or greater than a sum of the minimum value of the set pressure of the back pressure valve 15, the inlet-outlet pressure difference of the meter-out flow controller when the meter-out flow rate adjusted by the meter-out flow controller has a maximum value and a discharge flow rate of the hydraulic pump has a maximum value, and a motor inlet-outlet pressure difference necessary to drive the hydraulic motor 4 with no load; therefore, a minimum meter-in pressure required for driving the hydraulic motor 4 with no load is ensured even if there is no supplementation of hydraulic fluid through the regeneration flow passage and the set pressure of the back pressure valve is set to the minimum value. Besides, setting the set pressure of the low-pressure relief valve 16 to be equal to or greater than the maximum value of the set pressure of the back pressure valve 15 makes it possible to prevent the low-pressure relief valve 16 from being opened, when the hydraulic fluid is supplied from the meter-out flow passage to the meter-in flow passage through the regeneration flow passage, that is, a regeneration operation is performed, under the condition that the set pressure of the back pressure valve 15 is set to the maximum value, to hinder the meter-in pressure from being increased.

Besides, the controller 20, in the apparatus shown in FIG. 1, performs a pilot pressure control, based on the engine speed detected by the engine speed sensor 17 and the remote-control pressure (for the lowering drive mode) detected by the remote-control pressure sensor 18, so as to reduce the pilot pressure (outlet pressure of the pilot pressure reducing valve 19) corresponding to the remote-control pressure as the engine speed becomes lower, thus improving the function of fine manipulation in low engine speed conditions.

For example, the apparatus shown in FIG. 5, where the discharge rate of the hydraulic pump 2 is reduced to reduce a lowering speed as the engine speed becomes lower, enables fine manipulation of the suspended load 7 to be performed by reducing the engine speed. Differently, the apparatus shown in FIG. 1 allows a shortage in the meter-in flow rate with respect to the meter-out flow rate to be automatically supplemented by hydraulic fluid supplied from the regeneration flow passage, even when the discharge rate of the hydraulic pump 2 is reduced due to a reduction in the engine speed, so that the reduction in the engine speed does not directly result in a reduction in the lowering speed. However, the controller 20 in the apparatus shown in FIG. 1 also can reduce the meter-out flow rate as the engine speed is reduced to enable the fine manipulation of the suspended load 7 to be performed, similarly to the apparatus shown in FIG. 5, by performing the control of reducing the outlet pressure of the pilot pressure reducing valve 19 as the engine speed is reduced.

Means to thus reduce the meter-out flow rate as the engine speed is reduced is not limited to the combination of the pilot pressure reducing valve 19 and the controller 20 shown in FIG. 1. For example, the meter-out flow rate can be reduced by electromagnetically operating the meter-out flow controller. Specifically, the meter-out flow controller shown in FIG. 1 may be configured such that the spring chamber of the meter-out flow regulation valve 14 receives an input of an outlet pressure of a solenoid-operated pressure reducing and the outlet pressure is controlled. In detail, in the case of high engine speed, the control of increasing the outlet pressure of the solenoid-operated pressure reducing valve enables a flow rate in the meter-out orifice 32 to be increased, while, in the case of low engine speed, reducing the outlet pressure of the solenoid-operated pressure enables the flow rate in the meter-out orifice 32 to be reduced.

The meter-out flow rate reducing means can be omitted on a case-by-case basis. For example, in the apparatus shown in FIG. 1, the pilot pressure reducing valve 19 may be omitted with piping to allow the lowering remote-control pressure output from the remote-control valve 10 to be directly input into the lowering-side pilot port 3*a* as a pilot pressure.

Figure 11:
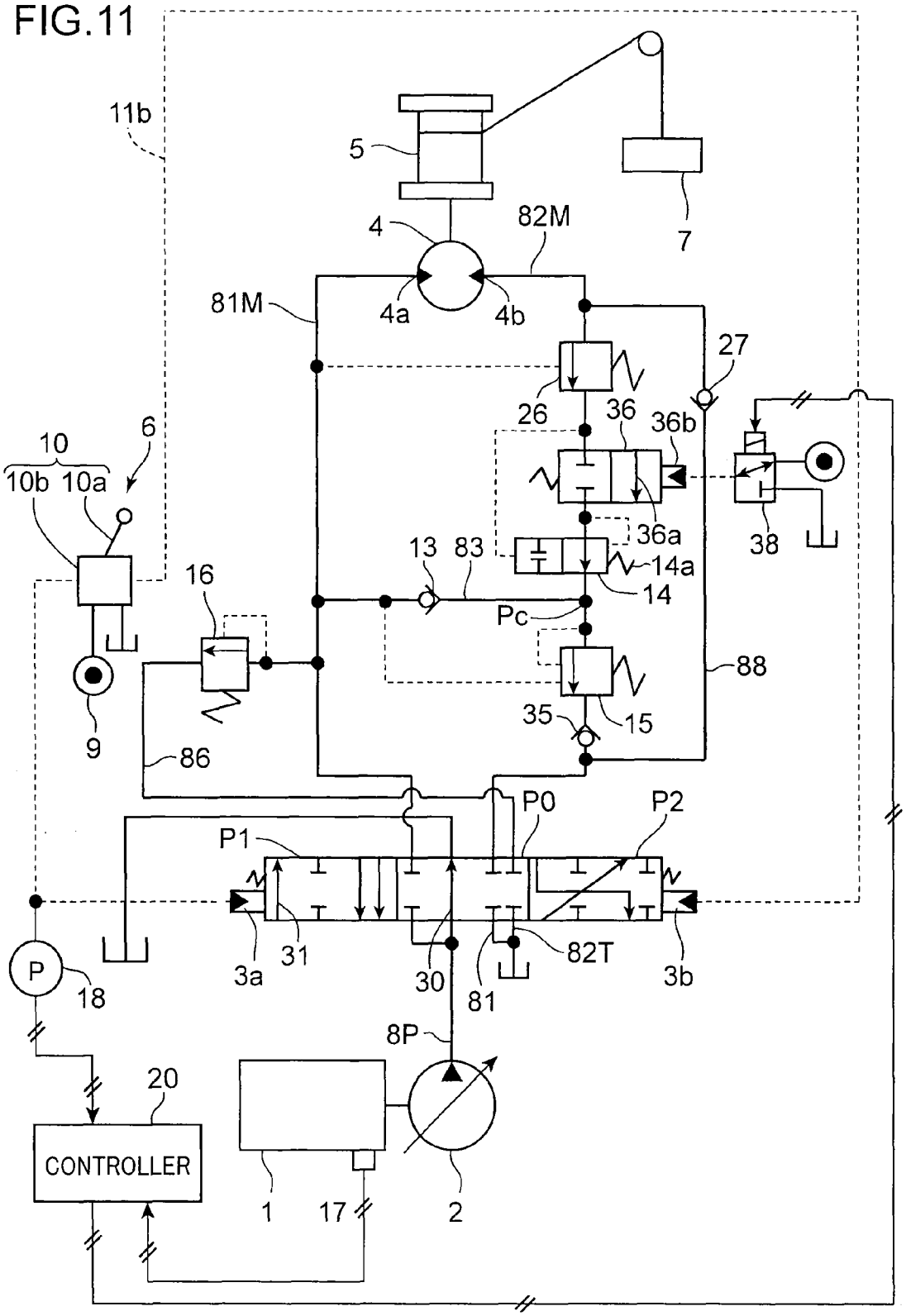
FIG. 11 is a circuit diagram showing a hydraulic driving apparatus for a working machine, according to a second embodiment of the present invention.

FIG. 11 shows an apparatus according to a second embodiment of the present invention. This apparatus is different from the apparatus shown in FIG. 1 in the following points.

(1) Positions of Valves

While the apparatus shown in FIG. 1 has such an arrangement that all of the meter-out flow regulation valve 14, the connection position Pc of the regeneration hydraulic line 83 and the back pressure valve 15 are provided in the first tank hydraulic line 81T downstream of the direction selector valve 3, the apparatus shown in FIG. 11 has such an arrangement that all of the meter-out flow regulation valve 14, the connection position Pc of the regeneration hydraulic line 83 and the back pressure valve 15 are provided in the second motor hydraulic line 82M upstream of the direction selector valve 3. In other words, the regeneration hydraulic line 83 is so arranged as to interconnect the first motor hydraulic line 81M and the second motor hydraulic line 82M, and the meter-out flow regulation valve 14 and the back pressure valve 15 are provided on upstream and downstream sides of the connection position Pc between the regeneration hydraulic line 83 and the second motor hydraulic line 82M, respectively.

(2) Meter-Out Flow Controller

While the meter-out orifice 32 constituting the meter-out flow controller, in the apparatus shown in FIG. 1, is included in the direction selector valve 3, the apparatus shown in FIG. 11 comprises, instead of the meter-out orifice 32, a pilot-operated throttle valve 36 provided in the second motor hydraulic line 82M and a solenoid-operated proportional pressure reducing valve 38 for controlling an opening area of the throttle valve 36. The pilot-operated throttle valve 36 has an orifice 36*a* having a variable opening area and a pilot port 36*b*, adapted to be moved so as to increase or reduce the opening area of the orifice 36*a* corresponding to a pilot pressure input into the pilot port 36*b*. The solenoid-operated proportional pressure reducing valve 38 is interposed between the pilot port 36*b* and a pilot hydraulic pressure source to output its outlet pressure corresponding to an instruction signal input thereinto and input the outlet pressure into the pilot port 36*b* of the throttle valve 36 as a pilot pressure. The input of the instruction signal into the solenoid-operated proportional pressure reducing valve 38 is performed by the controller 20. The controller 20 is operable to input, based on the remote-control pressure for the lowering drive mode detected by the remote-control sensor 18, into the solenoid-operated proportional pressure reducing valve 38, such an instruction signal as makes the opening area of the orifice 36*a* of the throttle valve 36 correspond to the remote-control pressure. Preferably, the controller 20 is operable to input, into the solenoid-operated proportional pressure reducing valve 38, an instruction signal for reducing the opening area of the orifice 36*a* of the throttle valve 36 corresponding to the remote-control pressure, i.e., reducing the meter-out flow rate, as the engine speed detected by the engine speed sensor 17 becomes lower.

Into the meter-out flow regulation valve 14 are input respective pressures on upstream and downstream sides of the throttle valve 36. The meter-out flow regulation valve 14 makes such a valve motion as to keep a difference between the upstream pressure and the downstream pressure, i.e., an inlet-outlet pressure difference of the throttle valve 36, be constant. Thus, the meter-out flow regulation valve 14 constitutes the meter-out flow controller in cooperation with the throttle valve 36.

The throttle valve 36 may be provided at a position upstream of the meter-out flow regulation valve 14 as shown in FIG. 11, or may be provided at a position downstream of the meter-out flow regulation valve 14 and upstream of the back pressure valve 15. In either case, the connection position Pc between the second motor hydraulic line 82M and the regeneration hydraulic line 83 is set at a position between the back pressure valve 15 and the meter-out flow controller including the throttle valve 36 and the meter-out flow regulation valve 14.

(3) Flow Passage During Raising Drive Mode

In the apparatus shown in FIG. 11, in order to secure a flow passage for supplying hydraulic fluid to the second port 4*b* of the hydraulic motor 4 during the raising drive mode, a bypass hydraulic line 88 is provided in parallel to the second motor hydraulic line 82M having the above valves, and a check valve 27 is provided in the bypass hydraulic line 88 to limit a flow direction of hydraulic fluid in the hydraulic line 88 to a direction from the direction selector valve 3 to the second port 4*b* of the hydraulic motor 4. Besides, the second motor hydraulic line 82M is provided with a check valve 35 between the direction selector valve 3 and the back pressure valve 15 to block the flow of the hydraulic fluid from the direction selector valve 3 into the back pressure valve 15.

Also in this apparatus, the orifice 36*a* of the throttle valve 36, i.e., the opening area of the meter-out orifice, is controlled, during the lowering drive mode, depending on the operation amount of the manipulation lever 10*a*, and the meter-out flow regulation valve 14 operates so as to maintain the inlet-outlet pressure difference thereof at a predetermined pressure; thereby the control of the meter-out flow rate according to the state of the manual operation is performed, irrespective of the weight of a load (suspended load 7). Besides, in a situation where the meter-in flow rate becomes less than the meter-out flow rate, the meter-in flow passage is supplemented with hydraulic fluid from the meter-out flow passage through the regeneration hydraulic line 83, while, in a situation where the meter-in flow rate becomes greater than the meter-out flow rate, the low-pressure relief valve 16 is opened; thus cavitation can be prevented with no use of the counterbalance valve, as with the apparatus shown in FIG. 1.

The direction selector valve 3 is not limited to a pilot-operated hydraulic selector valve, but may be, for example, a three-position solenoid-operated selector valve. Also in this case, a stable lowering drive operation can be achieved, if the meter-out flow controller is a type of controlling the meter-out flow rate depending on the state of the manual operation in the manipulation device, for example, a type of including the combination of the throttle valve 36 and the solenoid-operated proportional pressure reducing valve 38.

The hydraulic actuator included in the present invention is not limited to the hydraulic motor, but may be, for example, a hydraulic cylinder to move an attachment of a working apparatus. Also in this case, the present invention can be effectively applied for moving the attachment in a lowering direction, that is, a self-weight falling direction thereof. Alternatively, the hydraulic actuator may be a variable displacement motor.

As described above, the present invention provides a hydraulic driving apparatus for a working machine, designed to drive a load in a lowering direction equal to a self-weight falling direction of the load by means of hydraulic pressure, and capable of preventing pressure on a meter-in side from an excessive lowering and driving a load at a stable speed, while involving no occurrence of hunting and large boosted pressure, which are disadvantages in the conventional counterbalance valve. The hydraulic driving apparatus comprises: a hydraulic pump; a driving power source for driving the hydraulic pump to cause the hydraulic pump to discharge hydraulic fluid therefrom; a hydraulic actuator having a first port and a second port, the hydraulic actuator being adapted to drive the load in the lowering direction by receiving a supply of hydraulic fluid discharged from the hydraulic pump through the first port and discharging the hydraulic fluid from the second port; a manipulation device adapted to be manually operated to designate an operating speed of the hydraulic actuator; a hydraulic circuit for work including a meter-in flow passage for leading hydraulic fluid from the hydraulic pump into the first port of the hydraulic actuator during a mode for driving the load in the lowering direction, a meter-out flow passage for leading hydraulic fluid discharged from the second port of the hydraulic actuator into a tank during the mode for driving the load in the lowering direction, and a regeneration flow passage communicating the meter-out flow passage with the meter-in flow passage; a control valve for changing a state of the supply of hydraulic fluid from the hydraulic pump to the hydraulic actuator so as to operate the hydraulic actuator at a speed designated by the manipulation device; a meter-out flow controller provided in the meter-out flow passage to adjust a meter-out flow rate, which is a flow rate of hydraulic fluid in a region of the meter-out flow passage upstream of a position where the regeneration flow passage is connected to the meter-out flow passage, to a flow rate corresponding to a speed designated by the manipulation device; a back pressure valve provided in the meter-out flow passage at a position downstream of the position where the regeneration flow passage is connected to the meter-out flow passage, to produce a predetermined back pressure; a check valve provided in the regeneration flow passage to limit a flow direction of hydraulic fluid in the regeneration flow passage to a direction from the meter-out flow passage to the meter-in flow passage; and a non-regeneration operation relief valve to determine an upper limit of the pressure of the meter-in flow passage by being opened, when a pressure of the meter-in flow passage becomes equal to or greater than a set pressure thereof, to let out hydraulic fluid flowing through the meter-in flow passage to the tank. The set pressure of the non-regeneration operation relief valve is set to a value which is equal to or greater than a sum of a minimum value of a set pressure of the back pressure valve, an inlet-outlet pressure difference of the meter-out flow controller when the meter-out flow rate adjusted by the meter-out flow controller has a maximum value and a discharge flow rate of the hydraulic pump has a maximum value, and an actuator pressure difference necessary to drive the hydraulic actuator with no load, and is set to a value equal to or greater than a maximum value of the set pressure of the back pressure valve. In the case where the set pressure of the back pressure valve is fixed, the maximum value and the minimum value of the set pressure are, of course, identical.

In this apparatus, the meter-out flow controller provided in the meter-out flow passage adjusts the meter-out flow rate to a value corresponding to a designated speed, thereby maintaining a lowering speed of the load at a value corresponding to the manual operation of the manipulation device to thus achieve high performance of manipulation and safety.

In addition, the combination of the back pressure valve, the regeneration flow passage, and the non-regeneration operation relief valve on the side of the meter-in flow passage makes it possible to ensure a minimum pressure of the meter-in side to prevent cavitation on the meter-in side from occurring with no use of the conventional counterbalance valve. Specifically, in a situation where the meter-in flow rate is less than the meter-out flow rate, a part of the hydraulic fluid flowing through the meter-out flow passage is supplied from an upstream side of the back pressure valve to the meter-in flow passage through the regeneration flow passage, thereby preventing the meter-in pressure from lowering due to a shortage in the meter-in flow rate. On the other hand, in a situation where the meter-in flow rate is greater than the meter-out flow rate, there is no supply of hydraulic fluid from the meter-out flow passage to the meter-in flow passage through the regeneration flow passage, and the non-regeneration operation relief valve provided in the meter-in flow passage is opened at a time when the pressure of the meter-in flow passage has reached the set pressure thereof, thereby determining the upper limit of the meter-in pressure.

Furthermore, since the set pressure of the non-regeneration operation relief valve is set to a value which is equal to or greater than a sum of a minimum value of a set pressure of the back pressure valve, an inlet-outlet pressure difference of the meter-out flow controller when the meter-out flow rate adjusted by the meter-out flow controller has a maximum value and a discharge flow rate of the hydraulic pump has a maximum value, and an inlet-outlet actuator pressure difference necessary to drive the hydraulic actuator with no load, it is possible to ensure a minimum meter-in pressure required for driving the hydraulic actuator with no load under the condition that no hydraulic fluid is supplied from the meter-out flow passage to the meter-in flow passage through the regeneration flow passage and the set pressure of the back pressure valve is set to the minimum value. Besides, the set pressure of the non-regeneration operation relief valve is set to be equal to or greater than the maximum value of the set pressure of the back pressure valve, which prevents the non-regeneration operation relief valve from being opened when hydraulic fluid is supplied from the meter-out flow passage to the meter-in flow passage through the regeneration flow passage, i.e., a regeneration operation is performed, under the condition that the set pressure of the back pressure valve is set to the maximum value, to hinder the meter-in pressure from being increased.

Preferably, the meter-out flow controller includes a meter-out orifice having a flow passage area variable correspondingly to a manual operation of the manipulation device and a meter-out flow regulation valve for changing the meter-out flow rate so as to make an inlet-outlet pressure difference of the meter-out orifice be a predetermined value. The combination of the meter-out orifice and the meter-out flow regulation valve makes it possible to maintain a lowering speed of a load at a value corresponding to the state of the manual operation of the manipulation device, irrespective of the weight of the load, with a simple configuration.

In the present invention, it is preferable to enable the load to be driven not only in a lowering direction but also in a raising direction by using, as the hydraulic actuator, a type movable in forward and reverse directions, more specifically, a type operable to drive the load in the lowering direction by receiving a supply of hydraulic fluid to the first port and discharging the hydraulic fluid from the second port, and drive the load in a raising direction by receiving a supply of hydraulic fluid to the second port and discharging the hydraulic fluid from the first port. For this purpose, the control valve is preferably a direction selector valve which has a neutral position for blocking a supply of hydraulic fluid discharged from the hydraulic pump to the hydraulic actuator; a lowering drive position for forming a flow passage for directing hydraulic fluid discharged from the hydraulic pump to the first port of the hydraulic actuator through the meter-in flow passage and a flow passage for returning hydraulic fluid discharged from the second port of the hydraulic actuator to the tank through the meter-out flow passage; and a raising drive position for forming a flow passage for directing hydraulic fluid discharged from the hydraulic pump to the second port of the hydraulic actuator, and a flow passage for returning hydraulic fluid discharged from the first port of the hydraulic actuator to the tank.

In this case, it is preferable that: the direction selector valve has respective pilot ports corresponding to the lowering drive position and the raising drive position and is adapted to be moved from the neutral position, in a direction corresponding to one of the pilot ports receiving input of a pilot pressure, by a stroke corresponding to a magnitude of the pilot pressure, and the manipulation device includes a pilot hydraulic pressure source and a remote-control valve unit interposed between the pilot hydraulic pressure source and each of the pilot ports and adapted to supply a pilot pressure corresponding to a state of the manual operation thereof, to one of the pilot ports corresponding to the state of the manual operation. This makes it possible to easily make the meter-out orifice correspond to the state of the manual operation of the remote-control valve unit, by means of the pilot pressure.

For example, if the direction selector valve is configured to be moved from the neutral position to the lowering drive position or the raising drive position, in a direction and by a stroke each corresponding to the state of the manual operation of the manipulation device, including an orifice in the lowering drive position, the orifice having an opening area variable corresponding to the stroke of the direction selector valve, it is possible to simplify the circuit configuration by utilization of the orifice in the lowering drive position of the direction selector valve as the meter-out orifice of the meter-out flow controller.

Besides, it is preferable that the hydraulic driving apparatus of the present invention further comprises a rotation detecting device for detecting one of a rotational speed of the hydraulic pump and a rotational speed of the driving power source, and meter-out flow rate reducing means which reduces the meter-out flow rate to be adjusted by the meter-out flow controller in response to the manipulation device, as the rotational speed detected by the rotation detecting device becomes lower. The meter-out flow rate reducing means reduces the meter-out flow rate to be adjusted correspondingly to the manual operation of the manipulation device to reduce the operating speed of the hydraulic actuator, when a discharge rate of the hydraulic pump is reduced due to a reduction in the irrational speed of the hydraulic pump or the driving power source, thereby facilitating the performance of fine manipulation.

In the case of the hydraulic driving apparatus thus comprising the rotation detecting device and the meter-out flow rate reducing means and further comprising the direction selector valve composed of the above-mentioned pilot-operated selector valve and the remote-control valve unit constituting the manipulation device, it is more preferable that the meter-out flow rate reducing means includes a pilot pressure reducing valve interposed between the remote-control valve unit and the lowering-side pilot port of the direction selector valve and having a variable outlet pressure and a pressure-reducing-valve control device operable to reduce the outlet pressure of the pilot pressure reducing valve, as the rotational speed detected by the rotation detecting device becomes lower. This makes it possible to reduce the meter-out flow rate with a simple configuration utilizing a pilot circuit for the direction selector valve.

The set pressure of the back pressure valve may be constant, but it is more preferable that the set pressure of the back pressure valve is reduced as pressure of the meter-in flow passage is increased. Such a change in the set pressure makes it possible to keep the set pressure of the back pressure valve, namely, a back pressure, be low to thereby cut back on required driving power for the hydraulic pump, in the case of no requirement of a high back pressure, for example, the case where supplying hydraulic fluid to the meter-in flow passage through the regeneration flow passage is not required because the meter-in flow rate is greater than the meter-out flow rate, or the case of driving the load in a raising direction opposite to the lowering direction.

Specifically, preferable is that the hydraulic driving apparatus is provided with a fluid passage for introducing the pressure of the meter-in flow passage into the back pressure valve so as to reduce the set pressure of the back pressure valve by a value equal to the introduced pressure of the meter-in flow passage.

This application is based on Japanese Patent applications No. 2011-108293 and No. 2011-209678 filed in Japan Patent Office on May 13, 2011 and Sep. 26, 2011, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A hydraulic driving apparatus for a working machine, the hydraulic driving apparatus being designed to drive a load in a lowering direction equal to a self-weight falling direction of the load by means of hydraulic pressure and comprising:

a hydraulic pump;

a driving power source for driving the hydraulic pump to cause the hydraulic pump to discharge hydraulic fluid therefrom;

a hydraulic actuator having a first port and a second port, the hydraulic actuator being adapted to drive the load in the lowering direction by receiving a supply of hydraulic fluid discharged from the hydraulic pump through the first port and discharging the hydraulic fluid from the second port;

a manipulation device adapted to be manually operated to designate an operating speed of the hydraulic actuator;

a hydraulic circuit for work including a meter-in flow passage for leading the hydraulic fluid from the hydraulic pump into the first port of the hydraulic actuator during a mode for driving the load in the lowering direction, a meter-out flow passage for leading the hydraulic fluid discharged from the second port of the hydraulic actuator into a tank during the mode for driving the load in the lowering direction, and a regeneration flow passage communicating the meter-out flow passage with the meter-in flow passage;

a control valve for changing a state of the supply of the hydraulic fluid from the hydraulic pump to the hydraulic actuator so as to operate the hydraulic actuator at a speed designated by the manipulation device;

a meter-out flow controller provided in the meter-out flow passage to adjust a meter-out flow rate, which is a flow rate of hydraulic fluid in a region of the meter-out flow passage upstream of a position where the regeneration flow passage is connected to the meter-out flow passage, to a flow rate corresponding to a speed designated by the manipulation device, the meter-out flow controller including a meter-out orifice having a flow passage area variable accordingly to a manual operation of the manipulation device, and a meter-out flow regulation valve receiving inputs of respective pressures on upstream and downstream sides of the meter-out orifice and changing the meter-out flow rate to allow an inlet-outlet pressure difference of the meter-out orifice to become a predetermined value, the inlet-outlet pressure difference being a difference between the pressures on the upstream and downstream sides of the meter-out orifice;

a back pressure valve provided in the meter-out flow passage at a position downstream of the position where the regeneration flow passage is connected to the meter-out flow passage, to produce a predetermined back pressure;

a check valve provided in the regeneration flow passage to limit a flow direction of hydraulic fluid in the regeneration flow passage to a direction from the meter-out flow passage to the meter-in flow passage; and a non-regeneration operation relief valve adapted to be opened, when a pressure of the meter-in flow passage becomes equal to or greater than a set pressure thereof, to let out the hydraulic fluid flowing through the meter-in flow passage into the tank and thereby determine an upper limit of the pressure of the meter-in flow passage, wherein the set pressure of the non-regeneration operation relief valve is set to a value which is equal to or greater than a sum of a minimum value of a set pressure of the back pressure valve, an inlet-outlet pressure difference of the meter-out flow controller when the meter-out flow rate adjusted by the meter-out flow controller has a maximum value and a discharge flow rate of the hydraulic pump has a maximum value, and an inlet-outlet actuator pressure difference required for driving the hydraulic actuator with no load, and is set to a value equal to or greater than a maximum value of the set pressure of the back pressure valve.

2. The hydraulic driving apparatus as defined in claim 1, wherein:

the hydraulic actuator is operable to drive the load in the lowering direction by receiving a supply of the hydraulic fluid to the first port and discharging the hydraulic fluid from the second port and drive the load in a raising direction by receiving a supply of the hydraulic fluid to the second port and discharging the hydraulic fluid from the first port; and the control valve is a direction selector valve which has a neutral position for blocking a supply of the hydraulic fluid discharged from the hydraulic pump to the hydraulic actuator, a lowering drive position for forming a fluid passage for directing the hydraulic fluid discharged from the hydraulic pump to the first port of the hydraulic actuator through the meter-in flow passage and a flow passage for returning the hydraulic fluid discharged from the second port of the hydraulic actuator to the tank through the meter-out flow passage; and a raising drive position for forming a flow passage for directing hydraulic fluid discharged from the hydraulic pump to the second port of the hydraulic actuator and a flow passage for returning hydraulic fluid discharged from the first port of the hydraulic actuator to the tank.

3. The hydraulic driving apparatus as defined in claim 2, wherein:

the direction selector valve has respective pilot ports corresponding to the lowering drive position and the raising drive position, the direction selector valve being adapted to be moved from the neutral position, in a direction corresponding to one of the pilot ports receiving input of a pilot pressure, by a stroke corresponding to a magnitude of the pilot pressure; and the manipulation device includes a pilot hydraulic pressure source and a remote-control valve unit interposed between the pilot hydraulic pressure source and each of the pilot ports and adapted to supply a pilot pressure corresponding to a state of the manual operation thereof to one of the pilot ports corresponding to the state of the manual operation.

4. The hydraulic driving apparatus as defined in claim 3, wherein the direction selector valve is adapted to be moved from the neutral position to the lowering drive position or the raising drive position, in a direction and by a stroke each corresponding to the state of the manual operation of the manipulation device, the direction selector valve including an orifice in the lowering drive position, the orifice having an opening area variable corresponding to the stroke of the direction selector valve.

5. The hydraulic driving apparatus as defined in claim 3, further comprising a rotation detecting device for detecting one of a rotational speed of the hydraulic pump and a rotational speed of the driving power source and meter-out flow rate reducing means operable to reduce the meter-out flow rate to be adjusted by the meter-out flow controller in response to the manipulation device as the rotational speed detected by the rotation detecting device becomes lower, the meter-out flow rate reducing means including: a pilot pressure reducing valve interposed between the remote-control valve and the lowering drive-side pilot port of the direction selector valve and having a variable outlet pressure; and a pressure-reducing-valve control device operable to reduce the outlet pressure of the pilot pressure reducing valve as the rotational speed detected by the rotation detecting device becomes lower.

6. The hydraulic driving apparatus as defined in claim 5, which is configured such that the set pressure of the back pressure valve is reduced as pressure of the meter-in flow passage is increased.

7. The hydraulic driving apparatus as defined in claim 6, being provided with an fluid passage for introducing the pressure of the meter-in flow passage into the back pressure valve so as to reduce the set pressure of the back pressure valve by a value equal to the pressure of the meter-in flow passage.

8. The hydraulic driving apparatus as defined in claim 1, further comprising a rotation detecting device for detecting one of a rotational speed of the hydraulic pump and a rotational speed of the driving power source and meter-out flow rate reducing means operable to reduce the meter-out flow rate to be adjusted by the meter-out flow controller in response to the manipulation device as the rotational speed detected by the rotation detecting device becomes lower.

* * * * *